US006226916B1

(12) United States Patent
Kendall

(10) Patent No.: US 6,226,916 B1
(45) **Date of Patent: *May 8, 2001**

(54) BACK-FLASH CHECK FOR MUZZLELOADERS

(76) Inventor: Steven Scott Kendall, 7790 Lannenwood Dr., Howell, MI (US) 48843

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/106,052

(22) Filed: Jun. 26, 1998

(51) Int. Cl.[7] ..... F41A 17/00
(52) U.S. Cl. ..... 42/83; 42/51
(58) Field of Search ..... 42/83, 51, 69.01

(56) References Cited

U.S. PATENT DOCUMENTS

| | | | |
|---|---|---|---|
| 15,292 | 7/1856 | Halsey | 42/51 |
| 21,802 | 10/1858 | Schenkl | 42/51 |
| 36,464 | 9/1862 | Hopkins | 42/51 |
| 44,630 | 10/1864 | Hughes | 42/69 R |
| 60,791 | 1/1867 | Rowe | 42/83 |
| 158,221 | 12/1874 | Smith | 42/51 |
| 179,476 | 2/1876 | Ladd | 42/51 |
| 204,768 | 6/1878 | Slate | 42/69 R |
| 269,152 | 12/1882 | Züdorff | 42/51 |
| 3,451,154 | 6/1969 | Goble | 42/70 |
| 3,780,464 | 12/1973 | Anderson | 52/51 |
| 4,065,866 | 1/1978 | Eguizabal | 42/51 |
| 4,114,303 | 9/1978 | Vaughn | 42/51 |
| 4,123,867 | 11/1978 | Peterson | 42/83 |
| 4,135,321 | 1/1979 | Lewallyn | 42/83 |
| 4,163,335 | 8/1979 | Ives | 42/83 |
| 4,186,506 | 2/1980 | Pawlak et al. | 42/83 |
| 4,222,191 | 9/1980 | Lee et al. | 42/77 |
| 4,227,330 | 10/1980 | Chapin | 42/77 |
| 4,232,468 | 11/1980 | Chapin | 42/77 |
| 4,283,874 | 8/1981 | Vaughn | 42/51 |
| 4,384,423 | 5/1983 | Ritchie | 42/83 |
| 4,503,633 | 3/1985 | Davis | 42/51 |
| 4,519,157 | 5/1985 | Giangerelli | 42/83 |
| 4,700,499 | 10/1987 | Knight | 42/51 |
| 4,888,901 | 12/1989 | French et al. | 42/51 |
| 4,912,868 | 4/1990 | Thompson | 42/77 |
| 5,016,379 | 5/1991 | Lambert | 42/83 |
| 5,133,143 | 7/1992 | Knight | 42/51 |
| 5,408,776 | 4/1995 | Mahn et al. | 42/51 |
| 5,467,551 | 11/1995 | Krues | 42/83 |

(List continued on next page.)

*Primary Examiner*—Michael J. Carone
*Assistant Examiner*—Denise J. Buckley
(74) *Attorney, Agent, or Firm*—James C. McLaughlin

(57) ABSTRACT

An improved nipple, used with a percussion cap to ignite the propellent of a muzzleloader without significant ejecta from the nipple (back-flash), is disclosed. A check valve, preferably using a spherical actuator that is loosely retained within the valve chamber, is used to preclude back-flash. Use of a check valve and use of a relatively mild percussion cap (compared to primers) revealed a set of new problems that are solved by the disclosed device. Difficulty in removing spent caps, because of the lack of cap removing back-flash, was solved by flash chamber structure within the nipple adjacent to the cap. A tendency for the protective membranes of percussion caps to lodge within a nipple not having back-flash was cured by the use of an actuator retainer that directs the actuator to the side of the valve chamber during ignition. Ignition was improved by the use of a flash jet orifice and by the use of a directing actuator retainer. The disclosed nipple may be constructed so as to be exchanged for existing nipples in side-hammer, and in-line, cap-fired muzzleloaders. The disclosed nipple may be constructed so as to convert primer fired in-line muzzleloaders to percussion cap fired muzzleloaders and thus avoid the strictures of BATF Industry Circular number 98-2 dated Nov. 9, 1997.

6 Claims, 5 Drawing Sheets

U.S. PATENT DOCUMENTS

| | | | |
|---|---|---|---|
| 5,487,232 | 1/1996 | Osborne et al. | 42/51 |
| 5,511,334 | 4/1996 | Ball | 42/51 |
| 5,561,934 | 10/1996 | Knight | 42/51 |
| 5,604,326 | 2/1997 | Lescure | 89/26 |
| 5,632,109 | 5/1997 | Caudle | 42/51 |
| 5,644,861 | 7/1997 | Knight | 42/51 |
| 5,651,203 | 7/1997 | Knight | 42/25 |
| 5,657,569 | 8/1997 | Jernigan et al. | 42/83 |

BACK-FLASH CHECK FOR MUZZLELOADERS

TECHNICAL FIELD

The present invention principally relates to muzzleloading antique firearms, and more particularly to ignition systems for percussion cap type muzzleloading antique firearms. Most particularly, the field of the present invention includes such percussion cap ignition systems that essentially eliminate outward flow from the ignited propellent and improvements to such systems. The present invention is also applicable to rarely encountered breach loading antique firearms that use percussion caps.

DESCRIPTIONS OF PERCUSSION CAPS, PRIMERS, MODERN-PRIMERS, AND IN-LINE, MUZZLELOADING WEAPONS

The definition of a firearm is found in 18 USC §921(a)(3) and the definition for antique firearm is found in 18 USC §921(a)(16). Those definitions are followed herein.

Percussion caps are small metallic cups having a coating of ignition source material on their inside bottom. In use, a percussion cap is placed over, and surrounding the end of, a hollow tube, or conduit, that leads to a propellant charge. Percussion caps are ignited by striking the outside of the bottom of the cup and percussively compressing the ignition source material against the surface of the end of the tube. The cups are customarily made of a ductile material such as a copper alloy. These devices have been known since at least 1815.

Two kinds of primers are in use. Both types of primers include small metallic cups containing an ignition source material. Both types of primers are ignited by striking the outside of the bottom of the cup and percussively compressing the ignition source material against a pointed surface called an anvil and both were invented about 1870. The cup of a Boxer type of primer contains an anvil crimped into the cup so that the anvil's point is imbedded into the ignition source material, thus such primers merely need to be held while they are struck. The cup of a Berdan type of primer does not contain an anvil, so such primers need to be held over an anvil while they are struck.

The Bureau of Alcohol, Tobacco and Firearms (BATF) of the U.S. Department of the Treasury introduced "modern-primers" with Industry Circular number 98-2 dated Nov. 9, 1997. It appears that the position of the BATF is that in-line, muzzleloading weapons using modern-primers are regulated firearms (as defined in 18 USC 921(a)(3)) because the definition of ammunition found in 18 USC 921(a)(17)(A) includes the word "primer" and the definition of an antique firearm found in 18 USC 921(a)(16) does not include the word "primer." The Circular does not distinguish modern-primers from the Boxer and Berdan primers that have been essentially unchanged for the past 128 years. The Circular defines an in-line, muzzleloading weapon as "a muzzle loading firearm designed such that the firing mechanism (striker) is located directly behind the barrel" and such that "the striker moves forward in line with the bore of the weapon." The effect of the Circular includes causing the preferred primary ignition source for in-line, muzzleloading guns not to be modern-primers. The present invention includes the use of percussion caps as the primary ignition source of in-line, muzzleloading antique firearms.

All of the above described primary ignition sources perform the same task in essentially the same manner while using the same materials. To protect the ignitioin source material contained within the cup of each of the above described primary ignition sources from moisture, and the like, a paper like cover is used over the ignition source material (herein called a membrane). All commercially available, primers (and, presumably, modern-primers) are supplied with ignition source mate that is much hotter, when ignited, than the ignition source material supplied in percussion caps. Thus the ignition of propellent, all things being equal, is more difficult when percussion caps are used than when primers (and, presumably, modern-primers) are used.

BACKGROUND

The design and use of muzzleloading antique firearms (muzzleloaders) are well known. Muzzleloaders include (1) a barrel (with an open muzzle and a breach fitted with a plug) that holds the propellant charge and projectile at the breach end; (2) a primary ignition source, such as a percussion cap or flash pan filled with gun powder; (3) a striking device that ignites the primary ignition source either by impacting the percussion cap directly or by directing a spark into the flash pan; and (4) a small passage called a flash port, located at, or near, the breach end of the barrel, that directs the flash from the primary ignition source to the propellant charge. The function of the flash port is twofold, it directs the flash from the primary ignition source to the propellant charge and it prevents excessive back-flash from the burning propellant out of the rear of the barrel Increasing the cross sectional area of the flash port tends to enhance the desirable effectiveness of directing the flash from the primary ignition while tending to increase the undesirable back-flash. Thus the design of a flash port is necessarily a compromise. Excessive back-flash is undesirable both because it reduces the energy imparted to the projectile and because the ejecta poses a hazard to the user and persons near the rear of the muzzleloader. The function of the aforementioned striking device can be effected by passing an electric current through an ignition source or other schemes that might not involve, or appear to involve, a striking.

Herein, the term "percussion lock firearm" is used to encompass all guns using a primary ignition source that is separate from the propellant. Such a primary ignition source includes percussion caps, primers of all types, and flash pans. Also included are such ignition sources when using holders, spacers, disks, buffers or other auxiliary accessories.

Muzzleloaders that utilize a percussion cap as the primary ignition source are conventionally called cap-lock muzzleloaders or cap-locks. In cap-locks, the flash port is generally integrated into a removable nipple that also supports a percussion cap. Cap-locks are widely used by modern day hunters, and are the primary subject of the present invention. A threaded hole in the breach of the barrel of a cap-lock is fitted with a removable nipple that is configured to hold a percussion cap. The nipple supports the cap in a position that allows a hammer like striking device to impact the cap and thus initiate the primary flash.

Many configurations of percussion cap nipples have been introduced that conform to certain standard dimensions. Each of these designs strives to deliver the maximum primary flash into the barrel to ignite the propellant, while limiting back-flash.

The desirable goal of delivering a maximum flash to the propellant suggests a larger flash port would be better. However, a large flash port would allow excessive back-flash, outward through the flash port, of the high pressure gas generated by the burning propellant. Excessive back-flash is undesirable. It poses a hazard due to the presence of hot gasses and flying debris near the operator's face. Additionally, as a result of back-flash, smoke, soot and unburned propellant tend undesirably to accumulate on the mechanisms located near the gun's breach. Further, back-flash allows some of the propellent's pressure, which is intended to accelerate the projectile, to escape, thus undesirably lowering the muzzle velocity of the projectile.

Misfires (propellant fails to ignite) and hang-fires (propellant ignites after a significant delay) are common problems encountered in modern cap-lock muzzleloaders. An accumulation of unburned propellant (soot) in the path of the primary flash contributes to both misfires and hang-fires. In order to maintain the muzzleloader's accuracy, it is desirable to swab the barrel between shots. However, the act of swabbing the bore tends to move soot towards the breach end of the barrel and thus to deposit soot in the path of the primary flash, resulting in a hang-fire or a misfire on the subsequent shot.

Deactivation of the propellant is another cause of misfires and hang-fires in muzzleloaders. Oil used to clean the gun will deactivate the propellant on contact. Such oil fouling is common with in-line style cap-locks. The nipple is located in the center of the breach plug in in-ine cap-locks. During loading of the barrel with propellant and a bullet, the muzzle is pointed upward, which allows residual oil to flow downward and accumulate at the flash port. Thus, the greatest propellant deactivation occurs directly in the path of the primary flash.

FIG. 1 depicts a conventional percussion cap 30 and conventional nipple 20 installed in an in-line muzzleloader 10. Percussion cap 30 is seated on conventional nipple 20, which is within breach plug 14. When striker 16 strikes percussion cap 30, the explosive material within the cap is compressed between the cap's shell and the nipple's anvil 26 thus igniting the primary flash. The primary flash is directed into flash chamber 24 thence through flash port 22 and into barrel 12 past fouling 17, where it ignites propellent 18, which propels bullet 19. The high pressure gasses and flame from the burning propellant then travel back out through flash port 22 and flash chamber 24 lifting and sometimes fragmenting percussion cap 30. The present invention includes improvements to the prior art shown in FIG. 1.

PRIOR ART

Much effort has been directed, over many years, to the optimization of the size, shape and position of the flash chamber and flash port in nipples for cap-lock. muzzleloaders. Advancements in the prior art have taught that ignition characteristics are improved if the primary flash occurs in a relatively large diameter flash chamber and is then focused into a small diameter flash port. As an example, U.S. Pat. 4,186,506 to Pawlak discloses a nipple that is said to provide an improved ignition by tapering the diameter reduction between the flash chamber and the flash port. This patent discusses the need for an increase in the volume of the flash chamber. It states that "the volume of the primary section has been enlarged about twofold over earlier nipple designs."

The necessarily small flash port that is used in conventional cap-lock nipples, typically about 0.03 inches in diameter, or a cross sectional area of about 0.0007 square inches, reduces the intensity of the flash delivered to the propellant. If the flash port is fouled or the propellant has been partially deactivated by moisture or oil, a misfire may result. To overcome this, some systems have been introduced that use primers instead of percussion caps. The major distinction between primers and percussion caps is that primers deliver a hotter flash than do percussion caps.

U.S. Pat. No. 5,408,776 to Mahn discloses an ignition system for muzzleloading antique firearms that utilizes a rifle primer charge inserted into an annular flange. U.S. Pat. No. 5,644,861 to Knight discloses a device that allows the use of a rifle primer on a cap-lock muzzleloader. These references explain the advantages of using rifle primers instead of percussion caps. However, the U.S. Government has recently classified muzzleloaders that use modern-primers, which may include rifle primers, as firearms while those that use percussion caps remain classified as antique firearms (see discussion above). Also, the use of rifle primers in the special primitive arms hunting seasons is not allowed in all areas. Additionally, rifle primers are more expensive and less available than conventional percussion caps for muzzleloaders.

U.S. Pat. 3,780,464 to Anderson ('464 patent) discloses a check valve incorporated into a muzzleloader ignition system that utilizes a rifle primer as a primary ignition source. The rifle primer is enclosed by a separate metal cap and is struck with a firing pin. This design requires most guns to be extensively modified to accommodate the invention, which requires additional expense to the user. Anderson's invention has the disadvantages associated with using a rifle primer as the primary ignition source. A functional disadvantage of Anderson's invention is that the primary flash is dispersed as it travels through the valve, thus lessening the intensity and velocity of the primary flash as it impinges upon the propellant. Another disadvantage of Anderson is that the shape of the device tends to funnel soot and residual oil from the barrel into the flash path thus increasing the likelihood of a misfire or hang-fire.

Actual tests indicate that the device disclosed by Anderson is severely deficient if used with a percussion cap. Without knowledge of the existence of the '464 patent or the device disclosed therein, the early experimental precursor to the present invention was just a conventional nipple containing a check valve (the early device). It proved virtually impossible to remove fired percussion caps from that early device, indicating a very low utility for the early device. Had the early device used the Anderson metal cap and firing pin, it is doubtful that significant ignition flash could have been achieved using a percussion cap.

The problem of not being able to remove fired caps was solve by using the special flash chamber disclosed below. An intermediate device was produced that included a special flash chamber and a check valve within a nipple (the intermediate device). The intermediate device, now far from the Anderson device, proved able to be used to fire a muzzleloader well in excess of fifty times in rapid succession without cleaning and without fired percussion cap removal problems. This is almost unprecedented performance as the norm is that muzzleloaders will fail to fire after about fifteen discharges in rapid succession unless they are cleaned thoroughly. The intermediate device, though already of very great utility, was further improved by the addition of a flash jet disclosed below to produce the present device. The present device has the capability of firing a muzzleloader in spite of severe fouling.

SUMMARY OF THE INVENTION

The current invention includes a check valve and flash jet orifice that are located in the primary flash path of a muzzleloader, between the primary ignition source and the barrel. The check valve allows an open path of relatively large cross sectional area for gas flowing from the primary flash source to the barrel interior, and forms a seal against gas flowing out of the barrel through the nipple. The flash jet orifice directs the primary flash into a high velocity jet aimed at the barrel interior and away from, or through, accumulated soot and oil. The flash jet orifice also helps prevent oil and soot from filling the valve chamber during barrel cleaning and loading operations. Herein, "flash jet," "jet orifice," and "flash jet orifice" are used interchangeably. Flash chamber dimensions that provide reliable release of the spent percussion cap from the nipple are also disclosed.

The check valve includes a valve chamber containing a seat, an actuator and a retainer. The valve seat is located in the valve chamber end nearest a percussion cap support and flash chamber. A port communicates from the flash chamber through the seat. The actuator is positioned adjacent to, and on the barrel side of the seat and is free to move within the valve chamber between the seat and a retaining device. The valve seat limits the movement of the actuator away from the barrel as the actuator and seat contact to form a seal. A retaining device (retainer) limits the movement of the actuator toward the barrel while allowing an open path for ignition flash to travel past the actuator and the retaining device. Preferably, the retainer also is designed to direct the actuator to the wall of the valve chamber during ignition. Thus the preferred retainer facilitates the passage of the ignition flash and alleviates the problem of the percussion cap's membrane lodging inside of the nipple.

In order to focus the primary flash into a high velocity jet as it impinges upon the propellant, a flash jet orifice is located on the barrel end of the valve chamber. Preferably, where the dimensions of the muzzleloader allow, the jet orifice extends into the barrel a short distance to help prevent the accumulation of soot and oil in the path of the primary flash jet. The present invention is effective without the use of a flash jet.

The present invention, in its various embodiments, is configured to comply with the critical dimensions of the commonly accepted standard percussion cap nipples currently on the market. Thus, it is a direct replacement for conventional nipples and will accommodate the use of conventional percussion caps. The present invention is also able to be constructed so as to convert primer fired in-line muzzleloaders to percussion cap fired muzzleloaders and thus avoid the strictures of BATF Industry Circular number 98-2 dated Nov. 9, 1997.

It is an objective of the present invention to provide a one way valve ignition mechanism for muzzleloading antique firearms that maximizes the primary ignition flash delivered to the propellant while substantially eliminating back-flash from the burning propellant and to do so with a single, simple device.

It is a second objective of the present invention to provide a design that can be used in most standard cap-lock muzzleloaders without modification.

It is a third objective of the invention toe focus the primary flash into a high velocity jet that impinges the propellant.

It is a fourth objective of the invention to provide a flash check system that utilizes a conventional muzzleloader percussion cap.

It is a fifth objective of the invention to provide a jet orifice that extends into the barrel a short distance to minimize the effects of soot and oil in the path of the primary flash jet and that produces a high velocity ignition jet.

It is a sixth objective of this invention to provide a percussion cap support and flash chamber design that facilitates the release of a percussion cap from the supporting nipple after firing.

It is a seventh objective of this invention not to be affected by membrane lodging.

DETAILED DESCRIPTION OF THE INVENTION

The Prototype Embodiinent

Figure 2:
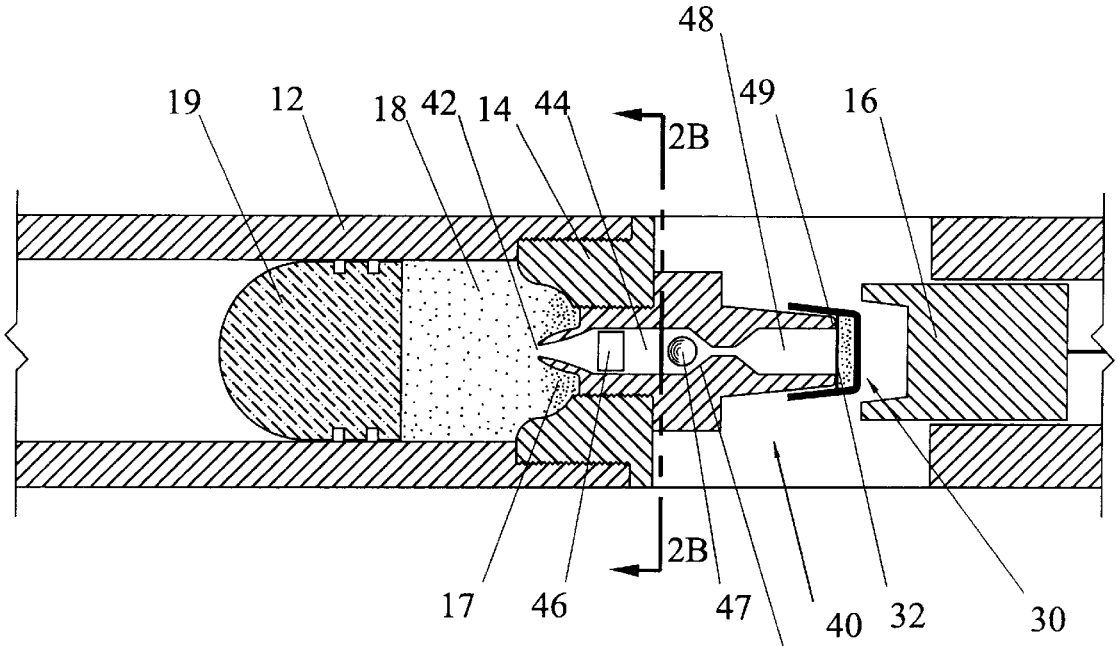
FIG. 2 Depicts an embodiment of the present invention for use in in-line muzzleloaders, installed in such a muzzleloader.
Figure 2B:
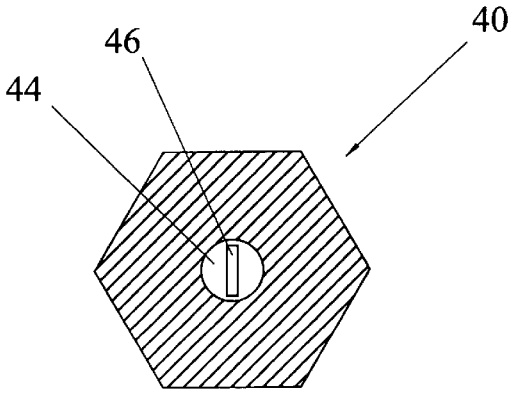
FIG. 2B Depicts a cross section of FIG. 2 looking into the valve chamber.

FIGS. 2 and 2B depict a prototype embodiment of the current invention as installed in an in-line muzzleloader 10. Back-flash check nipple 40 is screwed into the receiving threads of breach plug 14. Percussion cap 30 is seated on the anvil 49 of nipple 40. When striker 16 strikes percussion cap 30, the explosive material of the cap is compressed between the cap shell and anvil 49 thus igniting the primary flash. The primary flash is directed into flash chamber 48. The pressure of the primary flash moves actuator 47 away from valve seat 45. The primary flash then travels past actuator 47 and retainer 46 within valve chamber 44 and is directed by jet orifices 42 into a high velocity jet that ignites propellent 18. The preferred jet orifice 42, preferred retainer 41 and the preferred flash chamber 48 are discussed below. The preferred actuator 47 of the present invention is a metal sphere smaller in diameter than valve chamber 44, too large in diameter to pass into flash chamber 48, and of such a size as to be capable of forming a good seal or with valve seat 45. The preferred valve seat 45 of the present invention is capable of forming a good seal with actuator 47 (after ignition of propellent 18 has been effected) and it has been found that a smooth, conical surface inclined about 45 degrees to the major axis of nipple 40 is satisfactory (an included angle of about 90 degrees). If the included angle of valve seat 45 is too large then actuator 47 will tend not to seat properly. Too small of an included angle will tend to result in actuator 47 sticking after firing. The preferred angle between the surface of valve seat 45 and the major axis is about 65 degrees (an included angle of about 130 degrees). The retainer 46 of this embodiment of the present invention is formed by cutting off a small section of rectangular metal bar that is smaller than valve chamber 44, but too large to allow actuator 47 to pass. In this embodiment, actuator 47 is placed within valve chamber 44 followed by retainer 46, and the protruding parts of jet orifice 42 are deflected slightly inward so as to prevent the exit of retainer 46 from valve chamber 44 and so as to enhance the ignition flash.

The Jet

The flash jet orifice 42 of this embodiment extends a short distance into barrel 12, thus directing the primary flash away from accumulated fouling 17. The jet of hot gasses and flame impinges upon propellent 18 causing its ignition. The high pressure gasses and flame from the burning propellent 18 then forces actuator 47 against valve seat 45 forming a seal that substantially prevents the escape of hot gasses and flame from barrel 12 through nipple 40.

The extension of jet orifice 42 provides better ignition, particularly when firing an oil fouled barrel. Additionally, tests indicate that the low cross sectional area of the metal of the extension of jet orifice 42 effects a high temperature at its tip. This was indicated by examining the degree and color of the soot accumulated after firing. The walls of barrel 12, breach plug 14 and the base of nipple 40 were coated with a black soot while the tip of the extension of jet orifice 42 had relatively little gray colored soot on its surface.

It is evident that the utility of using a check valve with a flash jet is great. Whether used with percussion caps or with primers as the primary ignition source, significantly improved performance will be achieved with the combination.

The Ignition Path Release of Spent Percussion Cap

While the use of the check valve of the present invention with conventional percussion caps substantially eliminated back-flash, it introduced a new problem not anticipated by the prior art. The combination of greater flow of the primary flash into the barrel 12 and elimination of back-flash of the propellant gasses, so reduced the pressure developed in flash chamber 48 during firing that spent percussion cap 30 stuck to anvil 49. When early versions of the valve equipped nipples of the present invention were used, it was necessary to use a tool, and considerable effort, to remove the spent cap before reloading. This presented an unexpected problem to the use of a flash check valve with conventional percussion caps. In the prior art, such as disclosed in the '464 Anderson patent, which used much hotter primers to effect primary ignition, this problem was not encountered.

Figure 1:
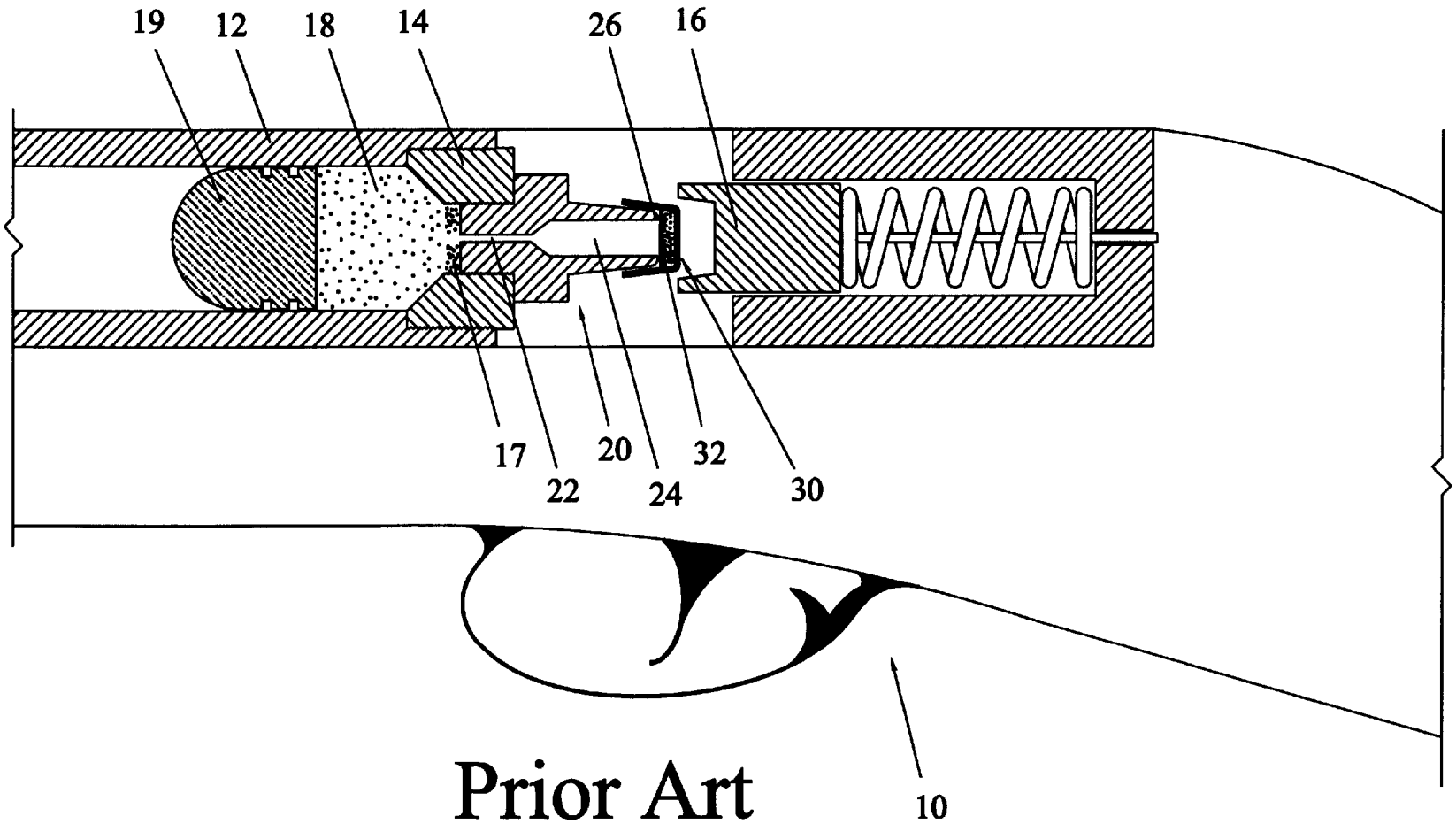
Prior Art Figure 1
FIG. 1 Depicts the prior art of a conventional percussion cap and nipple installed in an in-line muzzleloader.

In prior art using percussion caps, as shown on FIG. 1, the necessarily small flash port 22 of conventional nipple 20 caused sufficient pressure to develop in flash chamber 24 from the percussion cap flash that the spent cap fractured even when no propellent 18 was in barrel 12 to cause back-flash. When fired with a propellant charge, the back-flash through the conventional nipple 20 fractured the spent cap to the extent that usually only fragments remained.

Tests demonstrated that the methods used with conventional nipple 20 that were claimed to effect the release of the spent percussion cap were ineffective wherein used with an early version of the present invention. In an attempt to effect easy spent cap removal, vent holes cut into the side of nipple 40 having various diameters, and placed at different positions, were tested and found ineffective. Nipples were tried that were beveled to form an annulus between percussion cap 30 and the anvil 49 and found ineffective. The anvil 49 of several nipples 40 were notched to varying degrees to allow pressure to develop between the nipple 40 and percussion cap 30 and found ineffective. None of these methods reliably effected the release of the spent cap.

Tests were conducted using a vice to hold the present invention, and a hammer to effect ignition, so as to evaluate both the release of the cap and the flash through the device. Those configurations that showed promise were then tested in a conventional side hammer muzzleloader and in an in-line muzzleloader. The in-line muzzleloader proved to be the most difficult application with respect to the release of the spent cap. It was found that this was due to the even pressure applied to the cap by the striker of the in-line antique firearm.

It was learned, through extensive testing, that the internal dimensions of the flash chamber 48 have a dominate influence on the release characteristics of percussion cap 30. If, at any point within a distance of 0.23 inches (measured along the center line of nipple 40) from the nipple anvil 49, the cross sectional area of the flash chamber 48 is 0.008 square inches or less (measured on a plane perpendicular to the center line of the nipple 40), the spent cap deforms sufficiently to effect its release from nipple 40. Alternatively, if, within the flash chamber 48 for a distance of at least 0.23 inches (measured as before) from the nipple anvil 49, the cross sectional area of the flash chamber 48 is greater than 0.008 square inches (measured on a plane perpendicular to the center line of the nipple 40), the spent percussion cap 30 will tend to stick to the anvil 49 area of nipple 40. It is desirable to have a flash chamber 48 with a cross sectional area greater than 0.008 square inches at the tip of anvil 49 and then to reduce it to 0.008 square inches or less within 0.23 inch of the tip of anvil 49. However, it is functional to use a flash chamber 48 that is never greater than 0.008 square inches in cross sectional area. A flash chamber 48 that has a single diameter (cross sectional area) has the advantage of being easier to manufacture than one with multiple diameters.

If, at some point within 0.23 inches of the tip of anvil 49, the flash chamber 48 cross sectional area is 0.008 square inches or less, then the spent percussion cap 30 will be reliably released, or releasable, after firing regardless of the dimensions of the valve mechanism. It is thought that the explosive flash of percussion cap 30 develops a sonic pressure wave in flash chamber 48. It is known that the pressure in front of a sonic wave is not related to the pressure behind a wave. In this case, the pressure behind the sonic wave is developed as percussion cap 30 explodes. It is thought that the explosion of percussion cap 30 is complete by the time the sonic wave reaches a distance of 0.23 inch from the anvil. Thus, the dimensions of flash chamber 48 in the region where the explosion takes place, the first 0.23 inches, controls the pressure behind the sonic wave. Each described variation of the present invention uses a flash chamber that solves the unanticipated problem of spent percussion caps sticking to the nipple's anvil.

The Membrane Issue

An additional problem, associated with the use of a check valve, comes from membrane 32. Membrane 32 is present on the outside of percussion cap 30 to provide an oil and moisture barrier. During ignition, membrane 32 tends to tear and to be propelled into the ignition path. Without facilitating the flow of the membrane pieces into barrel 12, pieces of membrane 32 tend to lodge in valve chamber 44. Lodged pieces of membrane 32 would tend to occlude the ignition path and thus cause misfires. When the ignition path of the present invention (flash chamber 48, valve chamber 44, actuator 47, and a preferred retainer) is as herein disclosed, not only is the spent cap's removal facilitated, but pieces of membrane 32 tend not to become lodged.

The scheme used by the present invention to solve this problem includes the preferred use of a retainer that directs actuator 47 to one side of valve chamber 44 during ignition. Such directing not only tends to facilitate the flow of the ignition gasses into barrel 12, but simultaneously results in producing the maximum gap through which smaller pieces of the membrane will flow and across which the occasional larger piece of membrane might appear. A larger piece of membrane attempting to lodge is in the position of a long, thin, weak beam crosswise to a large force. The result is that a larger piece of membrane that attempts to lodge will buckle and pass through into barrel 12. Examination of FIG. 2B makes clear that, during ignition, actuator 47 will deflect to one side of retainer 46 and thus leave a sizable gap on the other side of retainer 46. Something equivalent is effected in each described variation of the present invention.

Prior art did not have a problem with membrane 32 because the ejecta out of the nipple tended to remove everything in the ignition path or, as in the case of the '464 Anderson patent, because the higher ignition (flash) energy from the use of a rifle primer must have shattered the membrane into tiny bits. Prior art did not recognize membrane lodging as an issue and had no reason to do so. The enhanced performance of the present invention, allowing the use of percussion caps without blow by, revealed a problem that the present invention solved by the use of schemes that direct actuator 47 off axis during ignition. Several schemes disclosed herein effect the desired retainer performance. The preferred retainer may be described as a hollow plug having its greatest extension within the valve chamber off center. Desirable retainers and deflectors may be effected by piercing the valve chamber with a pin or bar (preferably, the piercing is not medial).

Additional Embodiments Including The Preferred Embodiment

Figure 3:
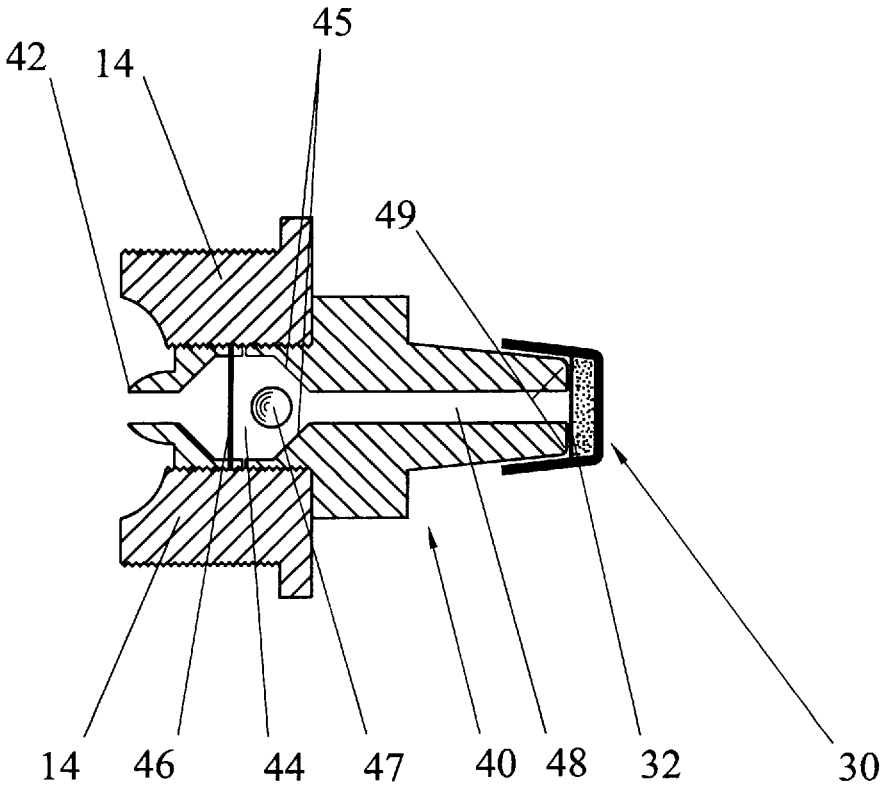
FIG. 3 Depicts an alternative embodiment of the present invention that has the flash jet separate from the nipple, installed in the breach plug of an in-line muzzleloader.

FIG. 3 shows a variation wherein nipple 40 is constructed in two parts. The first part includes anvil 49, flash chamber 48, valve seat 45, and at least part of valve chamber 44. The second part includes jet orifice 42 and the remainder of valve chamber 44. A spherical actuator 47 is placed farther from the barrel than retainer 46 and is prevented from leaving valve chamber 44 by retainer 46. FIG. 3 shows retainer 46 piercing the second part, but the proportions could be such that retainer 46 pierces the first part. The division of the present invention into two parts can effect production savings. Retainer 46 may be a bar or a pin. During ignition, actuator 47 will deflect to one side of retainer 46 and touch the wall of valve chamber 44 thus making optimum the ignition path.

Figure 4:
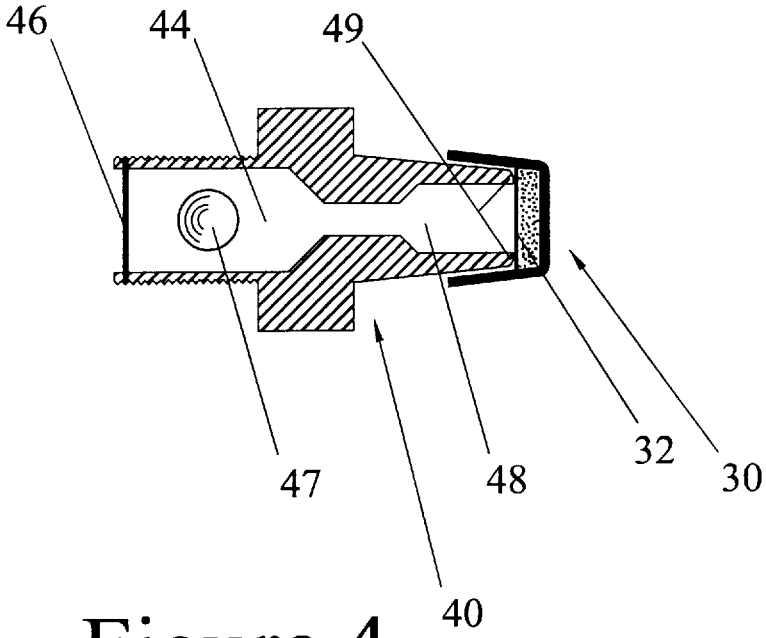
FIG. 4 Depicts an embodiment of the current invention that has no flash jet. This embodiment is particularly suitable for side hammer muzzleloaders, which tend to have limited clearance.

FIG. 4 shows a variation wherein nipple 40 is constructed without a flash jet. Side hammer muzzleloaders tend to have too little room or space at the end of a nipple to accommodate a flash jet. Thus this variation is particularly suitable for use with side hammer muzzleloaders. Retainer 46 may be a piercing bar or pin. During ignition, actuator 47 will deflect to one side of retainer 46 and touch the wall of valve chamber 44 thus making optimum the ignition path.

Figure 5:
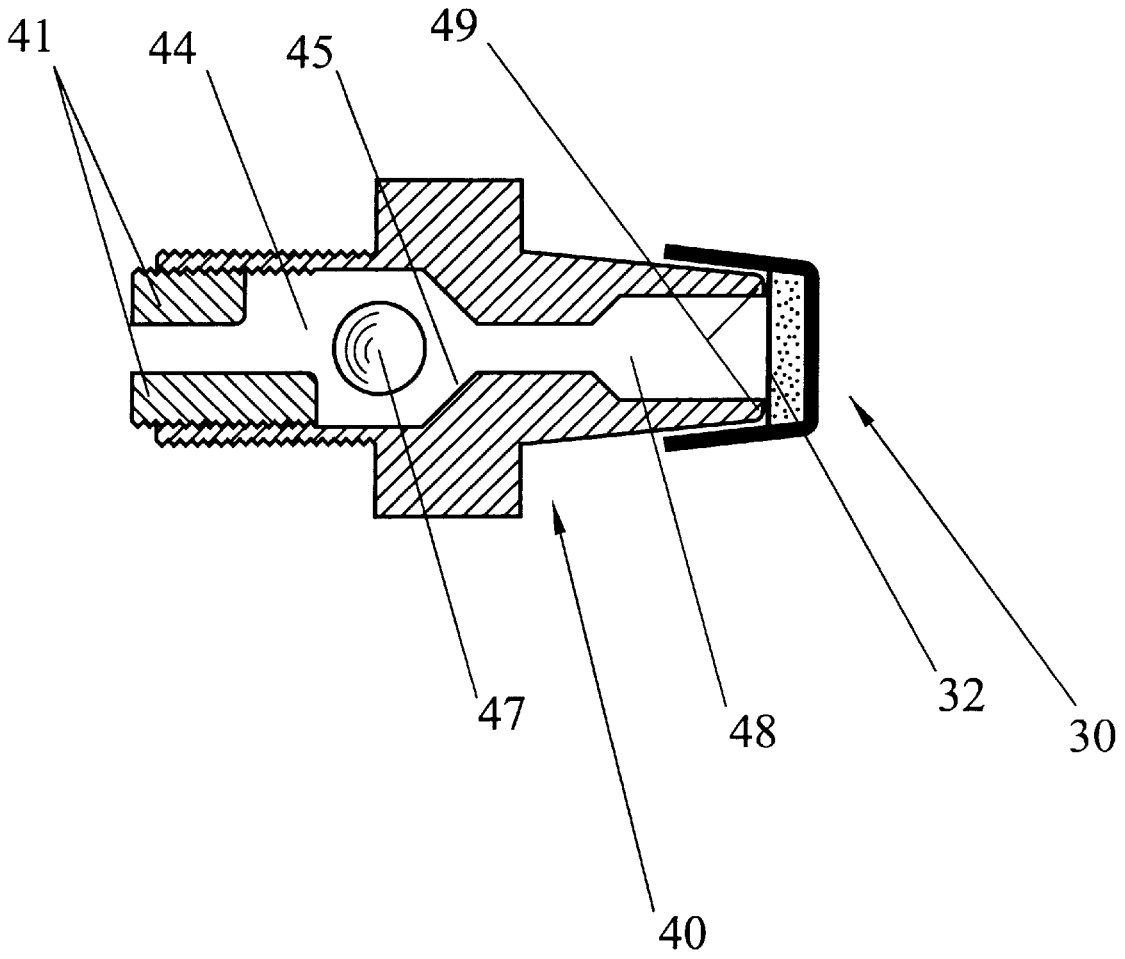
FIG. 5 Depicts an embodiment of the current invention in which the flash jet and retainer are combined.
Figure 6:
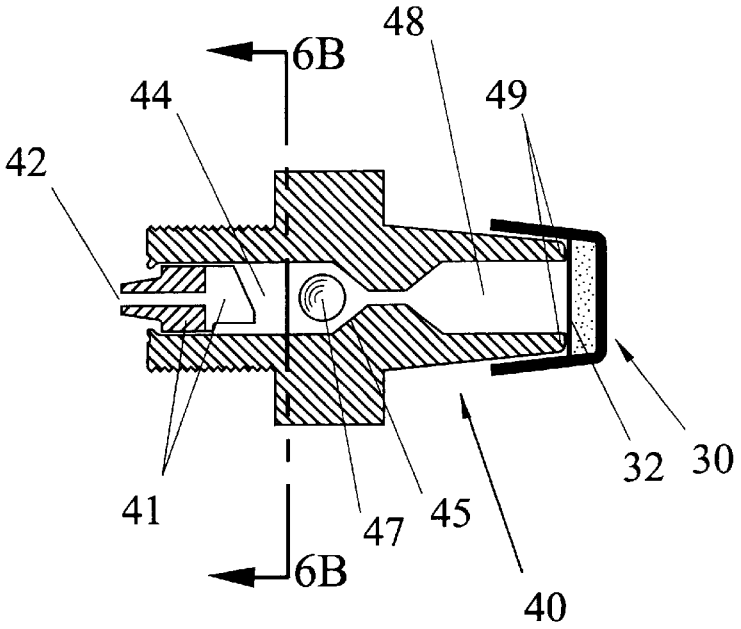
FIG. 6 Depicts the preferred embodiment of the current invention in which the flash jet and retainer are combined.
Figure 6B:
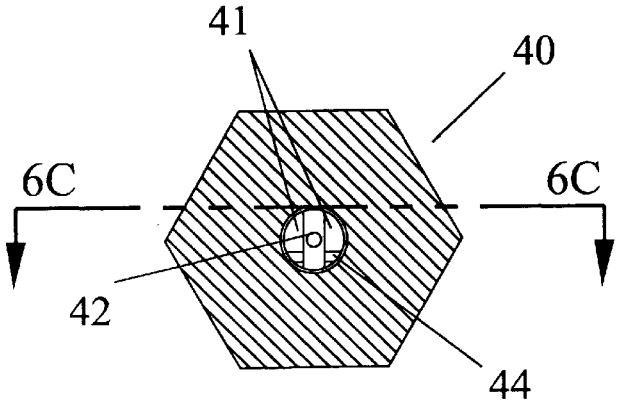
FIG. 6B Depicts a cross section through FIG. 6 looking into the valve chamber.

FIGS. 5 and 6 show variations that combine the flash jet and the retainer so as to effect production efficiencies. FIG. 5 shows combined jet orifice & retainer 41 constructed from a 6–32 set screw. The inside of valve chamber 44 nearest the barrel is threaded, a hole is drilled through a threaded rod, a partial cut is made at one end (as shown), actuator 47 is placed into valve chamber 44, and the threaded-drilled-cut rod (which is combined jet orifice & retainer 41) is screwed into valve chamber 44 so as to protrude slightly. The retainer so formed is a form of the preferred retainer.

Figure 6C:
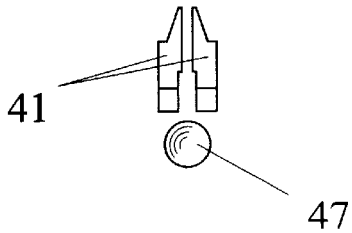
FIG. 6C Depicts a top cross section view of the combined jet orifice & retainer of FIG. 6.

FIG. 6, sectional view 6B, and top view 6C illustrate a combined jet orifice & retainer 41 constructed from a short piece of ⅛ inch OD tubing that has a 0.035 inch wall, and the assembly constitutes the preferred embodiment of the present invention. The combined jet orifice & retainer 41 of the preferred embodiment is effected by slotting one end of a tube for a short distance (shown in FIG. 6C), bevelling the same end (shown in FIG. 6), and then turning the other end to produce jet orifice 42. Actuator 47 is placed within valve chamber 44, the slotted-bevelled-turned tube (which is combined jet orifice & retainer 41) is placed beveled end first part way into valve chamber 44 so that jet orifice 42 protrudes, and the outside edge of valve chamber 44 adjacent to jet orifice 42 is peened or crimped to prevent the exit of combined jet orifice & retainer 41. This preferred retainer is strong and positively moves the actuator to one side during ignition thus providing an enlarged pathway for the ignition flash. The preferred retainer may be described as a hollow plug having its greatest extension within the valve chamber off center.

In all of the described variations of the present invention, including the preferred embodiment, the flash chamber 48 has dimensions to effect easy cap removal and use is made of a spherical actuator 47.

Modifications of the present invention are many and varied. The size and shape of the valve seat and actuator may be selected to best suit the particular application as long as the two pieces mate to form a seal against flow out of the barrel. The retainer may be of any shape that limits the travel of the actuator toward the barrel and does not obstruct the flash port. The jet orifice may take any shape that focuses or concentrates the primary flash to increase its intensity after it travels around the actuator. A single jet has been described, but multiple jets may also function to increase the flash intensity.

The benefits afforded by the jet orifice and its extension of the present invention may be applied to the rifle primer and check valve of Anderson's '464 patent. The flash jet will focus the primary flash into a high velocity jet thus increasing its intensity as it impinges the propellant. This will help reduce misfire and hang-fire, especially in an oil or soot fouled barrel. The extension of the flash jet into the barrel in this application will offer the advantages detailed above. Such an adaptation is an improvement to Anderson.

It is expected that the combination of a conventional nipple and flash jet extension will have improved attenuation of back-flash because of the non-bilateral nature of the flow into and out of such an orifice. With the availability of the present invention, such an improvement may well be moot.

The method used by the present invention to provide a release of the spent percussion cap from the anvil, and to prevent lodging of the membrane, may be applied to a system that has no jet orifice. The use of a percussion cap with a flash chamber in which the cross sectional area of the flash chamber is reduced to 0.008 square inches within 0.23 inches of the nipple anvil will provide a release of the spent cap when used with any check valve. This allows the use of a flash check system using percussion caps in many muzzleloaders that do not have room for a flash jet and cannot accommodate a rifle primer or do not wish to use a rifle primer.

The extension of the jet orifice is desirable in applications, such as in-line muzzleloaders, where space allows. However, many muzzleloaders do not have sufficient room for a flash jet extension. Embodiments that do not utilize a flash jet extension are included within the scope of this invention.

It is expected that one skilled in the art will be able to make adjustments to the shape and dimensions of the various components to optimize performance and to suit various muzzleloader designs while still operating within the scope of this invention.

Appendix

The terms "check valve," "conduit," and "deflector" are used herein and are not capable of appropriate labeling on the drawings. In lieu of the use of labeling on the drawings that would necessarily be too vague, the following reinforcement of the meanings of these terms is provided.

"Check valve" is defined above (in the Summary Of The Invention) to include a valve chamber containing a seat, an actuator and a retainer. These elements are individually capable of labeling on the drawings and are shown as: valve chamber 44, valve seat 45, actuator 47, and retainer 46. Alternatively, retainer 46 is combined jet orifice & retainer 41. The actuator-using check valve essentially prevents the outward flow of gas from the barrel.

"Conduit" is mentioned above (in the section entitled: Descriptions Of Percussion Caps, Primers, Modern-Primers, And In-Line, Muzzleloading Weapons) in the sentence:

In use, a percussion cap is placed over, and surrounding the end of, a hollow tube, or conduit, that leads to a propellant charge.

"Conduit" is used in the common way to describe a tube, channel, pipe, or the like for conveying fluids or objects and is used to describe the whole communicating path, and its contents, between a percussion cap placed over one end and propellant at the other end. The conduit provides communication from a primary ignition source (a percussion cap) to the barrel containing propellent. The conduit of the present invention is not capable of labeling on the drawings, but may include: nipple 40 with anvil 49, and flash chamber 48; check valve including valve chamber 44, valve seat 45, actuator 47, and retainer 46 (or combined jet orifice & retainer 41); and jet orifice 42, which might be combined with retainer.

"Deflector" (and the interchangeable word "director") refers to a function (scheme for deflecting the actuator) and is not capable of being labeled on the drawings. The deflecting/directing function is caused by the shape of the conduit and by various retainers 46 or the combined jet orifice & retainer 41, which are capable of being shown on the drawings.

Above, especially the section entitled The Membrane Issue, makes clear that the preferred embodiment of the present invention effects a "deflector" (used interchangeably with the word "director") to deflect the check valve's actuator during the first part of ignition in such a manner as to cure a defect found in the prior art, such as Anderson's patent. As stated above:

The enhanced performance of the present invention, allowing the use of percussion caps without blow by, revealed a problem that the present invention solved by the use of schemes that direct actuator 47 off axis during ignition.

What I claim is:

1. An ignition mechanism for percussion lock firearms using a percussion cap that surmounts an anvil at the end of a nipple that communicates with a firearm's barrel, comprising:

a flash chamber, within the nipple, extending from the anvil towards the barrel that has an internal cross sectional area that is 0.008 square inches or less at some point within 0.23 inches of the anvil; and a check valve located between said flash chamber and the barrel including a valve chamber communicating between said flash chamber and the barrel, a valve seat at the end of said valve chamber nearest to said flash chamber, an actuator free to move within said valve chamber and able to form a seal with said valve seat so as essentially to prevent the outward flow of gas from the barrel, and retainer means within said valve chamber, distant from said valve seat, for preventing egress of said actuator while maintaining communication of said valve chamber with the barrel, wherein said retainer means is effected by the step of piercing said valve chamber with a pin or bar.

2. The ignition mechanism of claim 1 wherein said piercing is not medial of said valve chamber.

3. An ignition mechanism for percussion lock firearms using a percussion cap that surmounts an anvil at the end of a nipple that communicates with a firearm's barrel, comprising:

a flash chamber, within the nipple, extending from the anvil towards the barrel that has an internal cross sectional area that is 0.008 square inches or less at some point within 0.23 inches of the anvil; and a check valve located between said flash chamber and the barrel including a valve chamber communicating between said flash chamber and the barrel, a valve seat at the end of said valve chamber nearest to said flash chamber, an actuator free to move within said valve chamber and able to form a seal with said valve seat so as essentially to prevent the outward flow of gas from the barrel, and retainer means within said valve chamber, distant from said valve seat, for preventing egress of said actuator while maintaining communication of said valve chamber with the barrel, wherein said retainer means comprises a hollow plug having its greatest extension within said valve chamber off center.

4. An ignition mechanism for percussion lock firearms using a primary ignition source that communicates with a firearm's barrel through a conduit that contains an actuator-using check valve essentially preventing outward flow of gas from the barrel, comprising:

a flash chamber, within the conduit, extending from the source towards the barrel that has an internal cross sectional area that is 0.008 square inches or less at some point within 0.23 inches of the source; and retainer means associated with the check valve for preventing egress of the actuator, wherein said retainer means comprises a hollow plug having its greatest extension within the check valve off center.

5. An ignition mechanism for percussion lock firearms using a primary ignition source that communicates with a firearm's barrel through a conduit that contains an actuator-using check valve essentially preventing outward flow of gas from the barrel, comprising:

a flash jet placed at the barrel end of the conduit that comprises one or more constrictions adapted to concentrate the ignition flash; and retainer means associated with the check valve for preventing egress of the actuator, wherein said retainer means comprises a hollow plug having its greatest extension within the check valve off center.

6. An ignition mechanism for percussion lock firearms using a primary ignition source that communicates with a firearm's barrel through a conduit that contains an actuator-using check valve essentially preventing outward flow of gas from the barrel, comprising:

a flash jet orifice placed at the barrel end of the conduit that comprises one or more constrictions adapted to concentrate the ignition flash;

a flash jet extension that extends said flash jet orifice a short distance into the barrel ending at a tip, whereby flash is directed away from accumulated fouling;

said flash jet extension's material has a low cross sectional area, whereby a high temperature of said material will be effected at said tip of said flash jet extension; and said low cross sectional area of said flash jet extension has a cross sectional area that is less than 0.01 square inches.

* * * * *